United States Patent [19]
Bobene

[11] 3,934,569
[45] Jan. 27, 1976

[54] APPARATUS AND METHOD FOR ATOMIZING FUEL-AIR MIXTURE IN A CARBURETION SYSTEM

[75] Inventor: Robert F. Bobene, Morton Grove, Ill.

[73] Assignee: Compression Dynamics, Incorporated, Skokie, Ill.

[22] Filed: Apr. 4, 1974

[21] Appl. No.: 457,700

Related U.S. Application Data

[63] Continuation-in-part of Ser. No. 383,378, July 27, 1973, abandoned.

[52] U.S. Cl. ..... 123/141; 48/180 R
[51] Int. Cl.[2] ..... F02M 29/00
[58] Field of Search ..... 48/180 R; 123/141

[56] References Cited

UNITED STATES PATENTS

| | | | |
|---|---|---|---|
| 1,279,771 | 9/1918 | Snider | 48/180 R |
| 1,295,513 | 2/1919 | Johnson | 48/180 R |
| 1,460,896 | 7/1923 | Freeman | 48/180 R |
| 1,542,933 | 6/1925 | Gepfert | 48/180 |
| 1,557,362 | 10/1925 | Harris | 48/180 R |
| 1,629,964 | 5/1927 | Price | 48/180 |
| 2,035,538 | 3/1936 | Dean | 48/180 |
| 2,657,123 | 10/1953 | Goldman | 48/180 |
| 3,077,391 | 2/1963 | Guffra | 48/180 R |
| 3,414,242 | 12/1968 | Bouteleux | 48/180 R |
| 3,449,098 | 6/1969 | Larson, Sr. | 48/180 R |
| 3,648,676 | 3/1972 | Lowman | 123/141 |
| 3,682,608 | 8/1972 | Hicks | 48/180 R |
| 3,747,581 | 7/1973 | Kolb | 48/180 R |

*Primary Examiner*—Charles J. Myhre
*Assistant Examiner*—R. H. Lamarus
*Attorney, Agent, or Firm*—Laff, Whitesel & Rockman

[57] ABSTRACT

An apparatus and process for atomizing a fuel-air mixture in an internal combustion engine by causing the fuel-air mixture to be driven in a funnel-type flow pattern in a passageway located between the engine's carburetor and intake manifold. The passageway includes a foraminous member disposed therein having an aperture and a grommet-rim therefore which comprises an aerodynamic surface in the path of the fuel-air mixture. The aerodynamic surface causes the fuel-air mixture to be driven in a circular path adjacent the outer wall of the passageway. The swirling fuel-air mixture is then drawn through the foraminous member where it is further atomized and conveyed to the intake manifold.

11 Claims, 9 Drawing Figures

APPARATUS AND METHOD FOR ATOMIZING FUEL-AIR MIXTURE IN A CARBURETION SYSTEM

This application is a continuation-in-part of applicant's previously filed application Ser. No. 383,378, filed July 27, 1973 for "Apparatus and Method for Atomizing Fuel-Air in a Carburetion System", now abandoned.

The present invention relates to an improved carburetor system for an internal combusion engine, and in particular, to a novel apparatus and process for atomizing a fuel-air mixture by producing a funnel-type flow pattern for the mixture as it exits from the carburetor and aerodynamically driving the mixture through a formainous member before passing the mixture into the intake manifold of the engine.

The operation of an internal combustion engine requires that the liquid fuel which it burns, such as gasoline, be mixed with air in proper amounts prior to combustion. A carburetor functions to create the optimum fuel-air mixture at all speeds and loads of the engine, by subdividing or atomizing the liquid fuel and intimately mixing the minute particles with the air introduced into the carburetor. Under ideal conditions, the fuel-air mixture furnished to the engine's intake manifold is a homogeneous mixture of small fuel particles in air. This atomization produces the maximum power output of the engine, and imparts to the mixture sufficient composition and strength to develop maximum economy for all conditions of engine operation. When the fuel and air are properly mixed, optimum combustion of the fuel results, limiting the amount of unburned fuel and smoke exhausting into the atmosphere and thereby reducing pollution of the environment.

Of the numerous prior devices which have been provided to secure more efficient atomization of the liquid fuel in carburetor systems, several include the use of a wire mesh screen located in the passageway between the carburetor and intake manifold of the engine. The screen breaks up, or atomizes, the fuel particles which are then more able to intimately mix with the air. Certain of these prior devices include a fan adapted to partially break up the flow the fuel and air current from the carburetor, and to produce a swirling motion to enhance the mixing capability of the system prior to passing the mixture through the screen.

Heretofore, the use of mesh materials or screens to provide proper atomization in a carburetion system has provided adequate results up to a certain point. It has been found that fuel systems on standard automobile engines equipped with screen atomizers have a tendency to "choke out" when certain speeds are reached. This is due to the reduction of effective flow rate of the mixture through the passage connecting the carburetor and intake manifold to the point that insufficient fuel-air mixture is being supplied to the engine. The area of the passageway is reduced by the cumulative area of the wire or fabric elements making up the mesh, and the flow rate, which is a function of the area across the passage, is similarly reduced. For example, an average six cylinder engine will stop operating at 70 miles per hour while an eight cylinder engine will choke out at approximately 50 miles per hour.

Since modern highway travel requires that automobile engines operate at speeds higher than 50 or 70 miles per hour, the use of a screen in the passage between the carburetor and intake manifold has been severely limited. This results in a severe disadvantage to the automobile owner, and to the public in general. First, the driver is denied of the opportunity to increase the efficiency and gas milege economy of his vehicle by installing a screen atomizer in his carburetion system. Second and most important, the public is denied the advantages of increased pollutant control and cleaner air, since the amount of smoke and un-combusted fuel exhausted into the air is reduced by the use of such screens.

It is an object of this invention, therefore, to provide a fuel-air mixture atomization system for an internal combustion engine which will function at all speeds of operation of the engine and which will provide the proper amount of atomization of liquid fuel and air necessary for optimum engine performance.

It is further an object of this invention to provide a carburetion system for an internal combustion engine wherein the flow rate of the fuel-air mixture passing from the carburetor through an atomizing device to the intake manifold of the engine is sufficient to prevent the engine from stalling at normal and high operating speeds and loads.

An additional object of my invention is to provide a fuel-air mixture atomizing device for the carburetion system of an internal combustion engine which creates a funnel-type flow pattern for the fuel-air mixture as it passes from the carburetor to the intake manifold of the engine.

Still another object of my invention is to provide a carburetion system for an internal combustion engine wherein a fuel-air mixture is driven in a funnel-type flow pattern through an atomizing member disposed in the flow path of the fuel-air mixture.

An additional object of the present invention is to provide a carburetion system for an internal combustion engine wherein the fuel-air mixture flowing through a passageway between the carburetor and the intake manifold of the engine is driven in a circular motion toward the outer wall of the passageway, and simultaneously driven through a foraminous atomizing element located in the passageway.

Yet another object of my invention is to provide a foraminous element for atomizing a fuel-air mixture in a carburetion system for an internal combustion engine, the foraminous element including aerodynamic means for creating a funnel-type flow pattern for the fuel-air mixture in the system.

Still another object of the present invention is to provide a novel process for driving a fuel-air mixture in a carburetion system in a circular motion adjacent the outer wall of a passageway containing the fuel-air mixture, and through an atomizing element forming part of the system.

A further and most important object of the present invention is to provide a carburetion system for an internal combustion engine which achieves increased engine efficiency, greater fuel economy, and while so doing, abates the dangers of air pollution by reducing the amount of hydrocarbon and carbon monoxide emissions from the engine.

According to one aspect of my invention, an atomizing member such as a foraminous element is located in the passageway carrying a fuel-air mixture from the carburetor to the intake manifold of an internal combustion engine. The foraminous element which may be either substantially flat or have a dished or depression configuration, includes an aperture therethrough which is circumferentially surrounded by a reinforced rim or grommet element having an aerodynamic surface facing into the fuel-air mixture flow. The aperture can be either centrally disposed or disposed at a distance from the center. The fuel-air mixture is drawn into the passageway at a predetermined flow rate by the vacuum created in the intake manifold during operation of the engine. As the mixture flows into the passageway, the aerodynamic surface of the grommet element creates a funnel-type flow pattern by causing the fuel-air mixture to be driven in a circular motion toward the outer wall of the passageway. The swirling fuel-air mixture is then drawn through the foraminous atomizing member where the droplets are further reduced in size to enhance complete combustion.

The nature of a preferred embodiment of the invention should become more apparent from a study of the attached drawings in conjunction with the following specification wherein.

Figure 1:
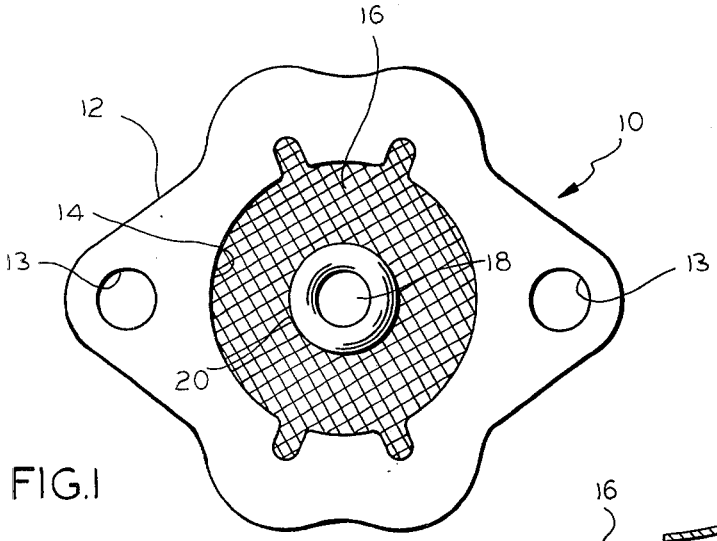
FIG. 1 is a plan view of the foraminous atomizing member, gasket, and aerodynamic element which is centrally located forming a first embodiment of the present invention.
Figure 3:
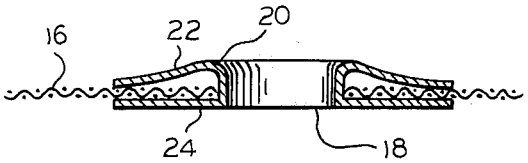
FIG. 3 is a detail view of the aerodynamic element shown in FIGS. 1 and 2.
Figure 2:
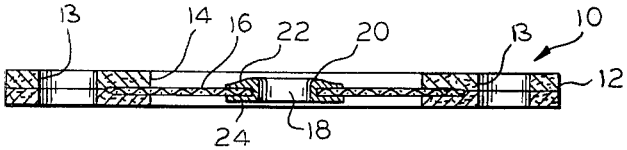
FIG. 2 is a cross-sectional view of the device of FIG. 1, taken along the line 2—2.

Referring to the drawings, FIGS. 1, 2, 3 and 7 disclose an atomizing member generally designated by the numeral 10. The atomizing member includes a gasket assembly 12 having an opening 14. A foraminous element 16 extends across opening 14 and is held in a sandwich-like manner by the upper and lower portions of gasket assembly 12. Holes 13 are provided in gasket assembly 12 to enable the atomizing member to be installed at the point of juncture of the carburetor and intake manifold of an internal combustion engine, as will be explained.

Foraminous element 16 is preferably a bronze wire screeen or a fabric mesh screen, having a density of approximately 20 apertures per linear inch. It is to be understood that the foraminous element 16 may be composed of other known materials such as stainless steel, meshed fabrics, a perforated plate, and be of various known materials without departing from the scope of the invention. Additionally, foraminous element 16 may be replaced with other known fuel-air mixture atomizing members within the teaching of my invention.

Located either in the center of foraminous element 16 (FIG. 1) or disposed at a distance from the center (FIG. 7) is an aperture 18, such as could be cut by a No. 14 leather cutter. A reinforcing rim is disposed around the circumference of aperture 13, as best disclosed in FIG. 3. In the embodiment of FIG. 1 the reinforcing rim comprises a grommet 20 having a curved upper surface 22 and a substantially flat lower surface 24. The portion of foraminous element 16 adjacent aperture 18 is clamped between the upper and lower surfaces 22, 24 of grommet 20, and thereby held in place surroudning aperture 18.

The curvature of the upper surface 22 of grommet 20 comprises an aerodynamic structure. The purpose of this construction is to create a funnel-type flow pattern of the fuel-air mixture in the carburetion system in which atomizing member 10 is used.

Figure 4:
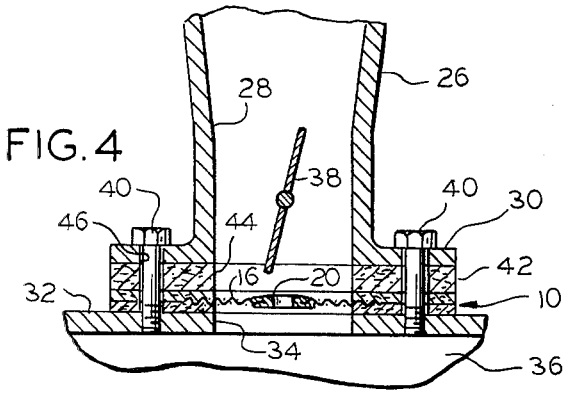
FIG. 4 is a side elevation view of a carburetion system embodying the embodiment of the present invention as shown in FIG. 1.
Figure 5:
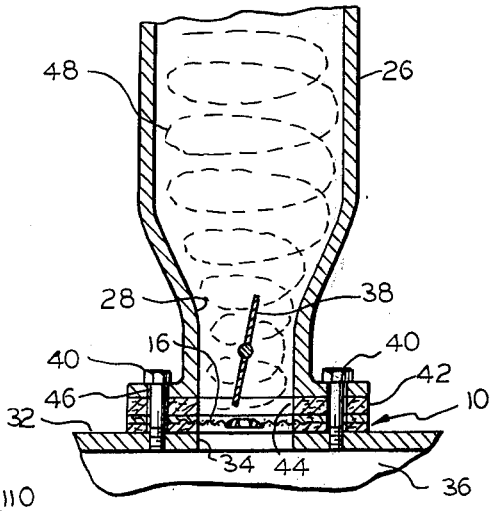
FIG. 5 is another side elevation of the carburetion system embodying the embodiment of the present invention as shown in FIG. 1, diagramatically showing the fuel-air mixture flow pattern during operation of the system.

The atomizing member 10 thus described is adapted to be used in the carburetion system of an internal combustion engine, the essential features of which are illustrated in FIGS. 4 and 5. A standard single barrel carburetor is designated 26, and has a passageway 28 at the lower end thereof for the flow of a fuel-air mixture from the carburetor. A butterfly valve 38 is located in passage 28 and controls the flow of the fuel-air mixture through the carburetion system. A flange 30 projects outwardly from the lowermost portion of the carburetor, and is adapted to mount the carburetor on intake manifold 36. A flange 32 extends outward from a passageway 34 forming part of engine intake mainfold 36. Passageway 34 is adapted to permit the fuel-air mixture in passageway 28 to be conveyed to intake manifold 36. A plurality of bolts 40 project through holes 46 to secure carburetor 26 in proper alignment relative to intake manifold 36.

In the preferred embodiment of my invention, atomizing member 10 is fastened by means of bolts 40 between flanges 30 and 32 of carburetor passageway 28 and intake manifold passageway 34. If butterfly valve 38 is located near the lower end of passageway 28, the butterfly valve is liable to remain caught in an open position if it contacts screen 16 or grommet 20, which is undesirable for obvious reasons.

One solution is to install or lift element 42 to prevent the butterfly valve from contacting foraminous element 16 or grommet 20 when moved to a full open position. Lift element 42 includes an opening 44 through which butterfly valve 38, as it pivots to an open position, and the fuel-air mixture from the carburetor are allowed to pass unobstructed.

Figure 9:
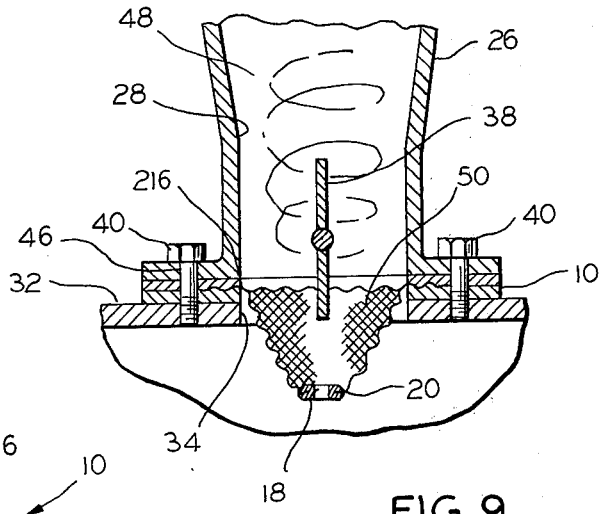
FIG. 9 is a side elevation of the embodiment of the invention disclosed in FIG. 8, diagramatically showing the fuel-air mixture flow pattern during operation of the system.
Figure 8:
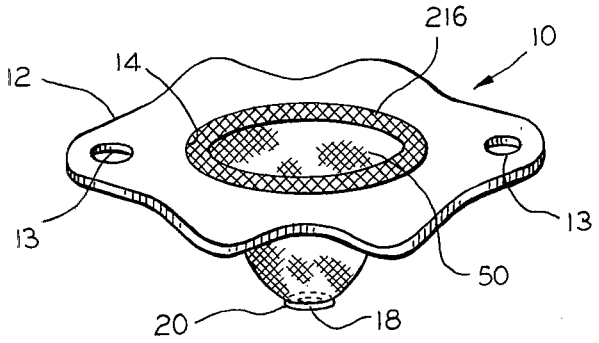
FIG. 8 is a perspective view of a third embodiment of the present invention, wherein the foraminous element of the atomizer comprises a dished depression configuration in which the aerodynamic element is located.

Alternately, as shown in the embodiment of my invention disclosed in FIG. 8, the atomizing member 10 can be designed with foraminous element 216 having a center dished depression 50. As is shown in FIG. 9, this enables butterfly valve 38 to move to a full open position without contacting foraminous element 216 or grommet 20. Additionally, the grommet 20 is located deeper into the intake manifold, which increases the effect of the swirling fuel-air mixture in passageway 28. In other material respects, the construction and operation of the embodiment of the atomizing member shown in FIG. 8 is the same as that of the embodiment of FIGS. 1–5.

Atomizing member 10 is installed in the carburetion system with foraminous element 16 extending transversely across passageway 28 and 34. Also upper or aerodynamic surface 22 of grommet 20 is located in passageway 28 facing opposite the direction of flow of the fuel-air mixture flowing from the carburetor. Gasket assembly 12 secures the outer portion of foraminous element 16 such that a fluid-tight seal is formed between flanges 30 and 32, preventing the escape into the atmosphere of any fuel-air mixture.

In operation, a fuel-air mixture is drawn from carburetor 26 through passageway 28 toward intake manifold 36 by operation of the internal combustion engine. As the fuel-air mixture enters the portion of the passageway 28 above atomizing member 10, the aerodynamic characteristic of upper surface 22 of grommet 20 causes the fuel-air mixture to develop a funnel-type flow pattern whereby the mixture is driven in a circular motion toward the outer wall of passageway 28. Simultaneously, the mixture is drawn through passageway 28 in an axial direction through foraminous element 16 which further atomizes the droplets of fuel-air mixture into smaller particles to enhance complete combustion of the fuel by increasing the total contact area of the fuel.

The turbulent or swirling motion imparted to the fuel-air mixture by the aerodynamic upper surface 22 of grommet 20 (which is diagrammatically illustrated by the numeral 48 in FIG. 5) causes the fuel-air mixture to move at a faster rate compared to drawing the mixture directly through foraminous element 16. Therefore, the flow rate of mixture is increased through the foraminous element, preventing a cut-off at normal and high engine operating speeds.

The present invention allows intake manifold 36 to be supplied with an adequate quantity of fuel-air mixture despite the presence of foraminous element 16 in the flow path of the mixture. By atomizing the fuel-air mixture into fine particles by means of foraminous element 16, greater fuel economy is achieved, and the quantity of hydrocarbons and carbon monoxide created is significantly reduced as a result of more complete combustion of the fuel by the internal combustion engine. The aerodynamic surface 22 of grommet 20 permits foraminous element 16 to be installed in passageway 28 without inhibiting movement of the quantity of fuel-air mixture which must be delivered to intake manifold 36 at normal and high engine operating speeds and loads to prevent stall or cut-off.

Figure 6:
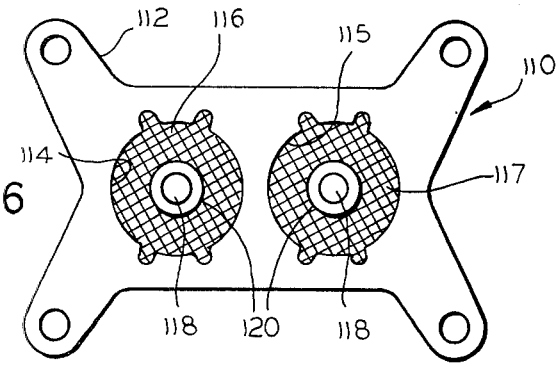
FIG. 6 is a plan view of an additional embodiment of the atomizing and aerodynamic members of my invention adapted for use with multi-barrel carburetion systems.

The above is a description of the preferred embodiments of my invention as installed on a single barrel carburetor system. However, atomizing member 10, or its equivalent, may just as readily be adapted for use in conjunction with a multi-barrel carburetion system. An example of such a construction is illustrated in FIG. 6, wherein 110 is an atomizing member having a gasket assembly 112 adapted to be installed between a multi-barrel carburetor and an intake manifold for an internal combustion engine. Openings 114 and 115 are provided in gasket assembly 112, and foraminous elements 116 and 117 extend across each opening. The center of each foraminous element includes an aperture 118 having a grommet 120 around the circumference thereof. As explained in conjunction with the embodiment of FIGS. 1 and 4, grommet 120 comprises an aerodynamic curved upper surface which faces opposite the direction of flow of the fuel-air mixture coming from the carburetor. In other material respects, the construction and operation of the embodiment of the atomizing member shown in FIG. 6 is the same as that of the embodiment of FIGS. 1–5.

Figure 7:
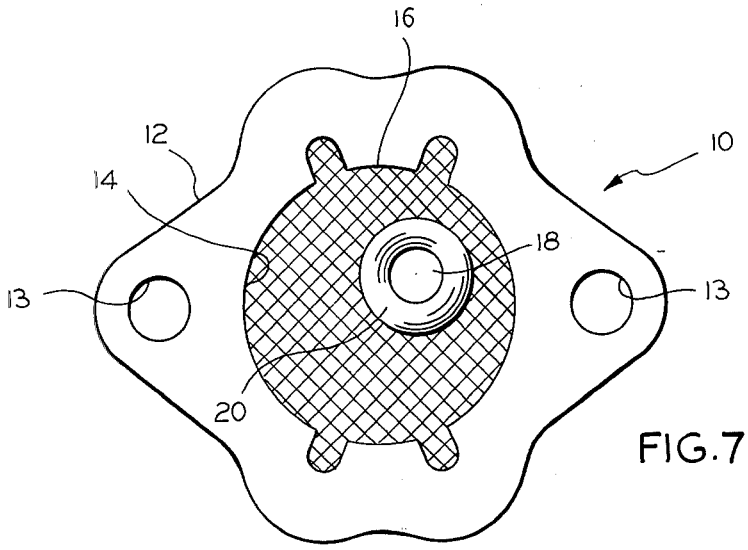
FIG. 7 is a plan view of a second embodiment of the present invention, wherein the aerodynamic element is disposed at a distance from the axial center of the foraminous element.

The embodiment of FIG. 7 is particularly adapted for increased efficiency where the engine to which the described carburetor is attached is operated for extended periods at partially open throttle settings. By locating grommet 20 off of center, partial opening of butterfly valve 38 will not restrict access to the grommet. Instead, grommet 20 will be located in a path between the wall of passageway 28 and the circumference tip of partially open valve 38. It has been found that this off-center location of grommet 20 increases the effectiveness of my atomizer when the throttle is partially open.

It will be understood that modifications and variations of the improved carburetion system disclosed herein may be resorted to without departing from the spirit of the invention and the scope of the appended claims.

The embodiment of the invention in which an enclusive property or privilege is claimed are defined as follows:

1. In an apparatus for atomizing a fuel-air mixture in an internal combustion engine having a a carburetor and an intake manifold, a passageway between said carburetor and said intake manifold for the flow of said fuel-air mixture therethrough, an atomizing member disposed generally transversely of said passageway, and laterally disposed aerodynamically configured means having an opening therethrough and completely supported by a foraminous member located in said passageway for creating a funnel-type flow pattern of said fuel-air mixture through said atomizing member in said passageway, said dynamically configured means forming a reinforced rim around the circumference of said opening and having one side facing opposite the direction of flow of said fuel air mixture through said passageway, said one side having substantially a curved aerodynamically curved configuration, said aerodynamically configured means allowing maximum flow of fuel-air mixture through said carburetor resulting in greater fuel economy and abatement of the discharge of pollutants.

2. The apparatus of claim 1 wherein said foraminous element is substantially flat.

3. The apparatus of claim 1 wherein said foraminous element includes a dished depression configuration.

4. The apparatus of claim 1 wherein said laterally disposed aerodynamically configured means which creates a funnel-type flow pattern of said fuel-air mixture, lies in plane normal to the axis of said passageway.

5. The apparatus of claim 4 wherein said aperture and aerodynamically configured means are centrally disposed in said atomizing member.

6. The apparatus of claim 4 wherein said aperture is disposed at a distance from the center of said atomizing member.

7. The apparatus of claim 1 wherein said means forming a reinforced rim comprises a grommet.

8. An atomizing member to be disposed in the fuel-air mixture flow path between the carburetor and intake manifold of an internal combustion engine comprising: a foraminous element means for positioning said foraminous element in said flow path; and an opening through said foraminous element, a reinforced rim around the circumference of said opening having a substantially curved aerodynamically curved configuration on one surface thereof to face the flow path of said air fuel mixture; said reinforced rim completely supported by said foraminous member and creating a funnel type flow pattern of said air fuel mixture through said foraminous element when positioned in said flow path.

9. The atomizing member of claim 8 wherein:

said foraminous element includes an aperture centrally disposed therein.

10. The atomizing member of claim 8 wherein said aerodynamically configured means is located at a distance from the center of said foraminous element.

11. The apparatus of claim 8 wherein said foraminous element is formed in a dished depression configuration.

* * * * *